US009726467B1

(12) United States Patent
Scott

(10) Patent No.: US 9,726,467 B1
(45) Date of Patent: Aug. 8, 2017

(54) POWDER MEASURE COVER APPARATUS

(71) Applicant: Gunhugger Enterprises LLC, San Tan Valley, AZ (US)

(72) Inventor: Michael David Scott, San Tan Valley, AZ (US)

( * ) Notice: Subject to any disclaimer, the term of this patent is extended or adjusted under 35 U.S.C. 154(b) by 0 days.

(21) Appl. No.: 15/223,362

(22) Filed: Jul. 29, 2016

(51) Int. Cl.
*F42B 33/02* (2006.01)

(52) U.S. Cl.
CPC ..... *F42B 33/0292* (2013.01)

(58) Field of Classification Search
CPC .... F42B 33/001; F42B 33/02; F42B 33/0292; B65D 81/3876; B65D 81/3879
USPC ..... 86/33, 31, 39
See application file for complete search history.

(56) References Cited

U.S. PATENT DOCUMENTS 1,933,529 A * 10/1933 Blackburn Murgatroyd ..... C03C 15/00 174/209
3,013,698 A * 12/1961 Gordon ..... F42B 33/0292 222/158
3,135,434 A * 6/1964 Mittelsteadt ..... F42B 33/0292 222/306
3,147,890 A * 9/1964 Mittelsteadt ..... F42B 33/0292 222/165
3,147,893 A * 9/1964 Mittelsteadt ..... F42B 33/0292 222/306
3,386,329 A * 6/1968 Rohrbacher ..... F42B 33/0292 86/31
3,501,053 A * 3/1970 Purdie ..... B65G 65/4881 222/306
3,808,939 A * 5/1974 Ashbrook ..... F42B 33/0292 86/28
4,151,933 A * 5/1979 Myers ..... G01F 11/024 222/288
6,121,556 A * 9/2000 Cole ..... G01G 13/04 141/83
7,624,665 B1 * 12/2009 Lee ..... F42B 33/001 86/20.1
D691,859 S * 10/2013 Schaaf ..... D7/606
D696,076 S * 12/2013 Azamy ..... D7/607
2005/0229862 A1 * 10/2005 Dirle ..... A01K 13/003 119/174
2007/0137317 A1 * 6/2007 Brone ..... G01N 1/20 73/863.54
2008/0083767 A1 * 4/2008 O'Neal ..... A47G 23/0216 220/739
2009/0242578 A1 * 10/2009 Bonilla ..... B65D 81/3876 220/739
2010/0122624 A1 * 5/2010 Jackson ..... F42B 33/10 86/23
2011/0079602 A1 * 4/2011 O'Malley ..... B65D 81/3876 220/739
2011/0307421 A1 * 12/2011 Molz ..... B65D 81/3876 705/500
2012/0043243 A1 * 2/2012 Selina ..... B65D 81/3876 206/459.5

(Continued)

*Primary Examiner* — Joshua Freeman
(74) *Attorney, Agent, or Firm* — Von Hellens & Bycer Law; Matthew L. Bycer

(57) ABSTRACT

A cover provided for a powder measure that includes a tubular sleeve to fit over hopper reservoir walls. The cover may include an informational card slot, and/or a moral patch. The cover may also include a viewing window slit or slits to provide viewing information on the fill level of the hopper while the cover is applied.

7 Claims, 4 Drawing Sheets

(56) References Cited

U.S. PATENT DOCUMENTS

2012/0067904 A1* 3/2012 Richmond ..... B65D 81/3876
220/592.16
2012/0132557 A1* 5/2012 Nowzari ..... B65D 23/085
206/459.5
2013/0020223 A1* 1/2013 White ..... A47G 23/0233
206/459.5
2013/0213987 A1* 8/2013 Drutz ..... B65D 81/3876
220/738
2013/0216991 A1* 8/2013 Sinnamond ..... B65D 81/3876
434/260
2013/0334233 A1* 12/2013Vandenlangenberg B65D 81/3876
220/592.16
2014/0048551 A1* 2/2014 Slipe, Sr. ..... B65D 81/3879
220/739
2014/0339240 A1* 11/2014 Moore ..... B65D 81/3876
220/592.17
2015/0008232 A1* 1/2015 Fidanza ..... B65D 55/16
220/592.24
2015/0190557 A1* 7/2015 Nobles ..... B65D 81/3876
220/737
2015/0191293 A1* 7/2015 Forcella ..... B65D 81/3876
220/592.16
2015/0265083 A1* 9/2015 Myers ..... A47G 23/0216
220/739
2016/0244206 A1* 8/2016 Coplin ..... B65D 23/08
2016/0368697 A1* 12/2016 Otero-Palacios .. B65D 81/3876

* cited by examiner

POWDER MEASURE COVER APPARATUS

BACKGROUND OF THE INVENTION

1. Field of the Invention

The present invention relates to gunpowder cartridge refilling system-related reservoirs. The present invention is more particularly related to housings for a reservoir of propellant in a powder measure.

2. Description of Prior Art

Propellant dispensers are known in the art to include a refillable propellant reservoir stationed over a measure meter for determining the appropriate amount of propellant and utilizing gravity to dispense the same for a bullet cartridge. The reservoir is commonly known as a hopper, containing a propellant (or "powder"). Powder measures, as they are known in the art, typically include a vertically tubular reservoir housing atop a measure and dispensing device. A typical hopper will include gunpowder or a specific grain size and grain weight. Typically grains-per-load includes the number of grains to meet a specific weight to be dispensed with each throw of a powder measure lever.

The reservoir housing, or commonly known as hopper, walls are typically made from a substantially optically transparent material such as a plastic of a polycarbonate or polysulfone, or otherwise transparent material. While some housings or hoppers are opaque, it is preferable to include a hopper that provides a translucent wall to allow a user to determine the amount of propellant left in the hopper. Therefore, opaque hopper housings have been known to include at least one or more windowed port to enable viewing of the contents held therein. Transparent plastic housings are often preferred as an economical and inexpensive method of manufacturing a powder measure reservoir. While opaque housings are known in the art, provision of such opaque housings may be less common, more expensive, and/or more difficult to construct with various windows.

As many common powder measure hoppers include a transparent plastic reservoir wall, the reservoir walls are subject to clouding when propellant or other substances typically adhere to the internal surface of reservoir walls. Hoppers may also include a tinted transparent material, for instance a red translucent plastic, that may provide more contrast to make viewing of the contents of the hopper more readily apparent. Tinted windows typically mollify the negative aspects of a cloudy hopper wall, while still allowing transparency to the user but suffer from the same conditions. Plastic hopper walls are often subject to ultraviolet radiation which further degrades or impacts the clarity of the hopper walls. As the hopper walls are degraded from ultraviolet radiation, the walls can become cloudy, brittle, or may even fail. Hopper walls may also be made of glass, making for an easily clouded surface and risk of fragile breakage. A padded cover can alleviate some issues associated with glass walled hoppers.

It is an object of the present invention to provide a cover for tubular walls within a hopper reservoir.

It is another object of the present invention to provide for protection of a hopper reservoir.

It is yet another object of the present invention to provide for a cover for a hopper including a window aperture.

It is still yet another object of the present invention to provide for a removable tag and indicator on a cover for a powder measure hopper.

It is a further object of the present invention to provide for ornamentation of powder measure hoppers.

These and other objects of the present invention will become apparent to those skilled in the art as the description thereof proceeds.

SUMMARY OF THE INVENTION

The present invention is directed to a cover for a powder measure hopper. The cover is preferably a tubular sleeve to fit over and snugly fit on a hopper vertical cylindrical wall. The cover may include a pouch on an external face, for instance to include a card slot with an open top end to slip in an information card. A window aperture may be included in the cover to provide viewing access of the hopper when the cover is applied. The window aperture is preferably a vertical slit cut out of the cover, but may also be filled with a transparent material, such as a thin plastic sheet or clear gummy material, or a mesh screen. The window may be long and run most of the length of the cover, or may include a multitude of slits, preferably offset to secure the cover. An ornamental indicia may be included, such as a morale patch with mating hook-loop fastener material.

The present invention also includes a powder measure with adapted cover. A hopper can hold a quantity of granular propellant in a cylindrical tubular reservoir with a transparent wall circumscribing said cylindrical tube. A tubular sleeve fits over the hopper reservoir wall. The sleeve may include a pouch on an external face with an open top end to allow insertion of a card. The sleeve may also include a window aperture to provide viewing access of the hopper when the sleeve is applied.

The present invention also includes a method of improving a powder measure hopper, including the use of a sleeve to protect a hopper wall. The sleeve provides for protection against impact damage and/or radiation. The sleeve may include an ability to receive a morale patch. The sleeve may include a viewing window to allow viewing of the supply within the covered hopper.

BRIEF DESCRIPTION OF THE DRAWINGS

The present invention will be described with greater specificity and clarity with reference to the following drawings, in which.

DESCRIPTION OF THE PREFERRED EMBODIMENT

The present invention is intended as a cover for a powder measure hopper reservoir. The cover may be a typical cylindrical cozy to be sized and affixed to the hopper. The cover may be comprised primarily of a foam or nylon cover. The cover is preferably opaque to ultra violet radiation. The cover may be stitched in the typical fashion of fabrics and textiles. The cover may include an elastic band, or the entire fabric of the invention may be elastic so as to tightly and snuggly fit on a measure hopper.

One feature of the present invention is the optional ornamental nature of the cover. The cover may include a pattern that is preferred by a user, for instance a camouflage pattern, a solid color, or otherwise as is known in the art to decorate a useful material. A patch may also serve to provide further ornamentation and/or personalization.

Figure 1:
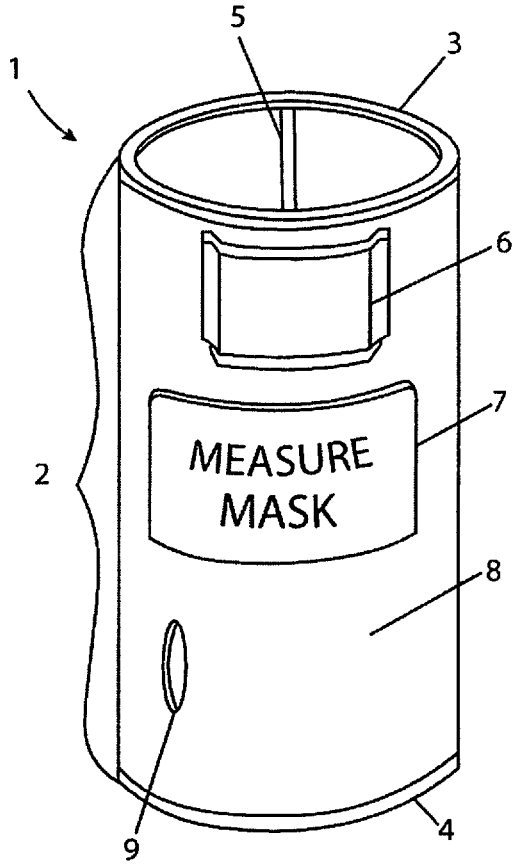
FIG. 1 illustrates a front view of an embodiment of the present invention.
Figure 2:
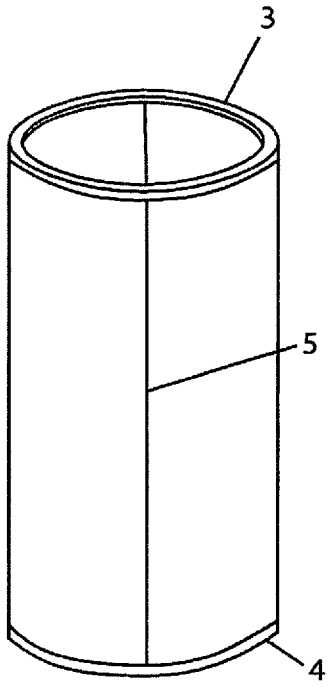
FIG. 2 illustrates a rear view of an embodiment of the present invention.

Referring now to FIGS. 1 and 2, cover 1 includes general cylindrical shape to vertically fit over a hopper. Cover 1 includes a height 2 bounded by a top rim 3 and bottom rim 4. When constructing the cover of the present invention, it may be required to stitch the product together along seam 5 in back. A display pouch 6 may be included on cover. Preferably, display pouch is on top front as shown. Ornamental indicia 7 may be included as an optional and removable characteristic of the cover. Ornamental indicia may be removably affixed to the surface 8 of the cover, such as via a hook and loop fastener. An optional window aperture 9 may be included to provide transparent access to the hopper thereunder. Window aperture 9 may be in the form of a slit as shown whereby the slit is vertical to allow for one to determine the presence, and/or height, of the propellant present in the hopper.

Figure 3:
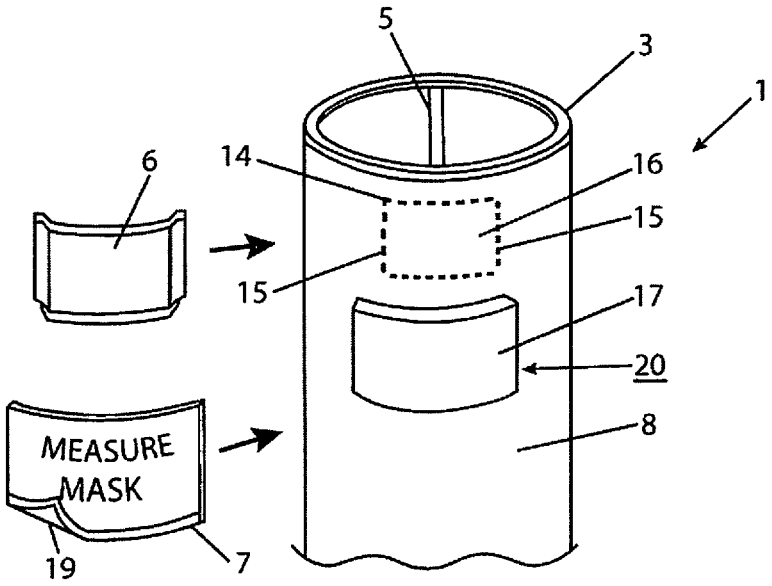
FIG. 3 illustrates an exploded view of the cutaway portion of an embodiment of the present invention.

Referring now to FIG. 3, a partially exploded view of the top front of the cover is shown. Cover 1 includes top rim 3 and stitch 5 as shown. Pouch 6 is shown off of the cover. Pouch 6 may be affixed on three sides 15 with an opening top 14 at the top of the pouch 6. Pouch is intended to provide for an insertable card that provides information relevant to the propellant that has been filled into the hopper. For instance, if the hopper is filled with a specific grain of propellant, the user can write on a card such information and place it within the pouch, or may use preprinted information cards. While the actual shape and size of an individual grain of propellant is sometimes called grain size, "grain" for our purposes refers to a unit of weight rather than shape/size. The powder measure is set to dispense a specific weight or charge size as measured in grains. The reloader can record the brand name of propellant and the charge size, collectively called "load data", on the card and put it in the window.

Ornamental indicia 7 is shown with the words "measure mask" and may be a pouch with a back surface 19 that includes a complimentary hook and loop fastener feature to mate with surface of indicia mount 20.

Figure 4:
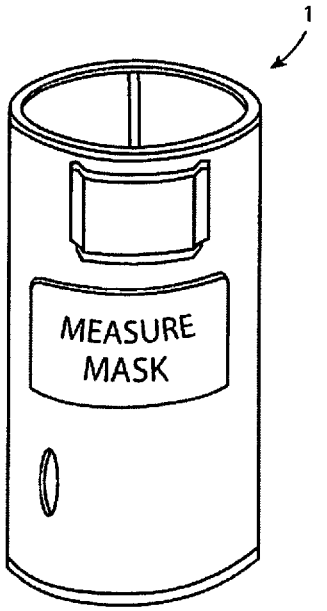
FIG. 4 illustrates a perspective frontal view of an embodiment of the present invention.
Figure 5:
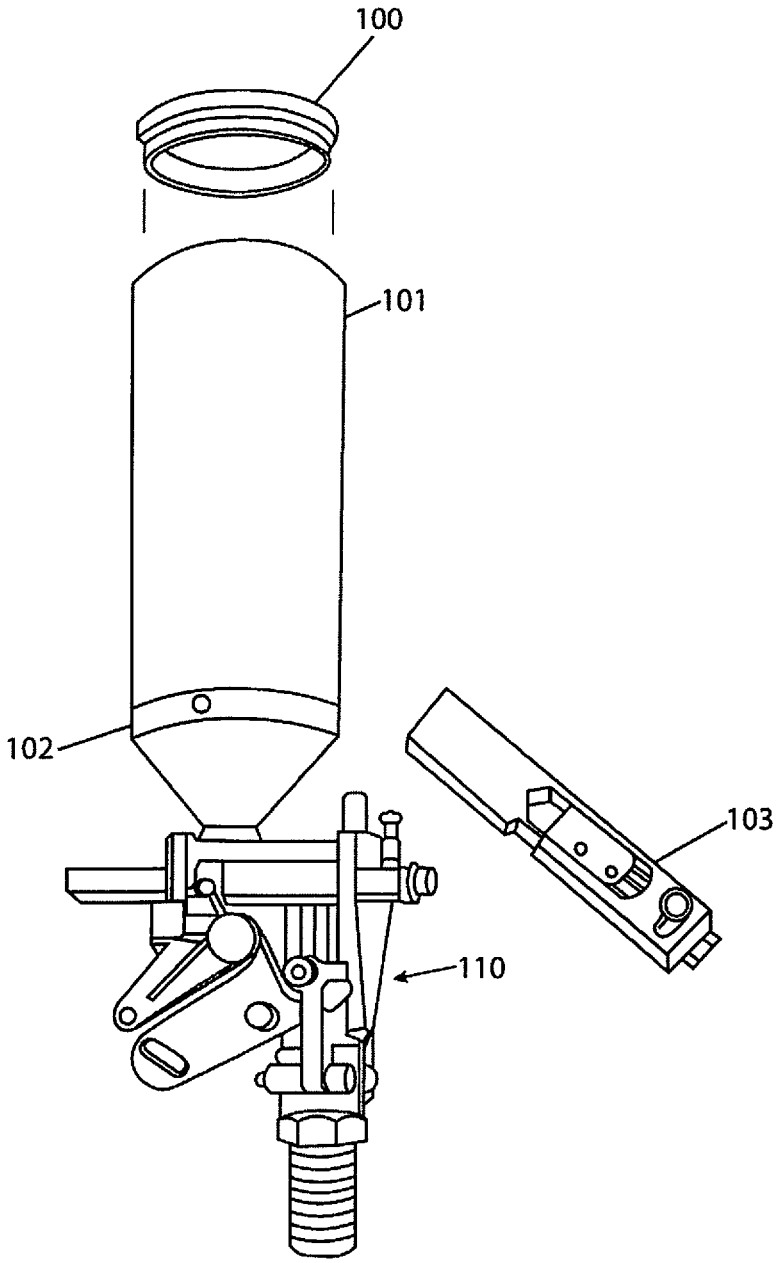
FIG. 5 illustrates a partially exploded view of a powder measure.
Figure 6:
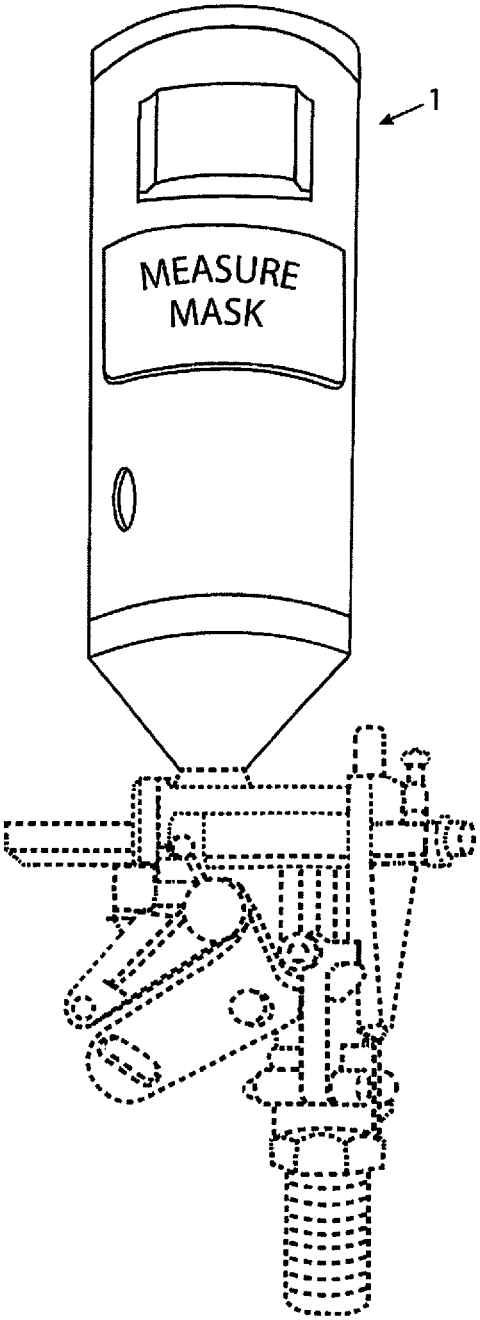
FIG. 6 illustrates an embodiment of the present invention as applied to a powder measure with a frontal view of an embodiment of the present invention.

Referring now to FIGS. 4, 5, and 6, the cover is intended for use with a powder measure 110. Powder measure 110 includes hopper 101, as is known in the art typically with a transparent plastic tubular reservoir. Hopper 101 is capped with cap 100. Hopper is placed above funnel 102 to provide for directing powder within hopper 101 through powder measure 110 to be metered by measure meter 103.

Figure 7:
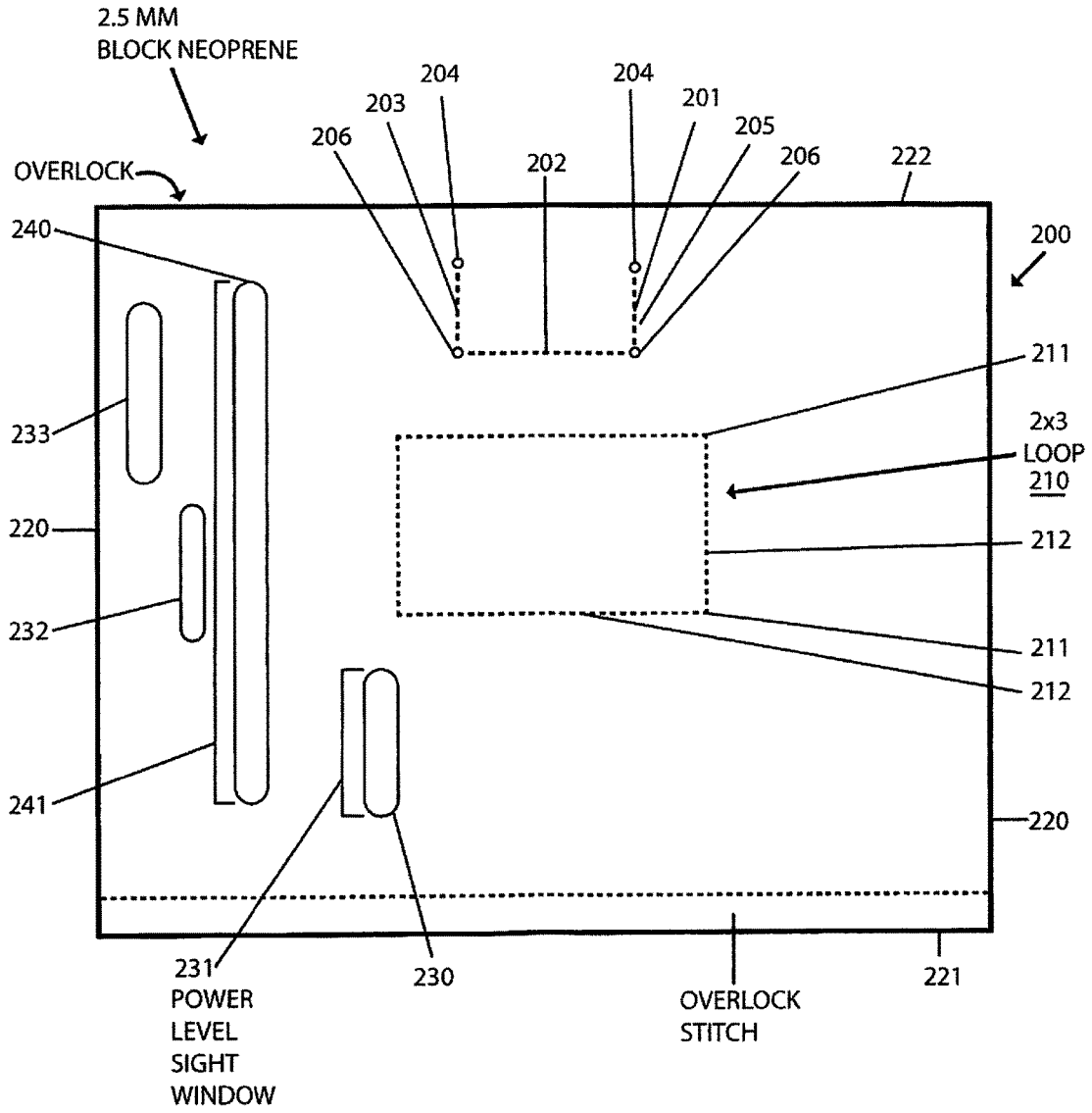
FIG. 7 demonstrates an open pattern outline of an embodiment of the present invention.

Referring to FIG. 7, an outline pattern of an embodiment of the present invention is shown when the cover is opened either by cutting the mask, or prior to sewing at seam. Cover 200 includes edges 220, 221 and 222, including vertical seam edges 220, top and bottom edges 222 and 221, respectively. Cover may be made out of any material suitable for providing protection and/or ornamentation to a hopper reservoir. Hopper walls may be made of a plastic, glass or otherwise, necessitating ornamentation or protection. Material is preferably a neoprene, such as a black neoprene, but may include any pattern or cover useful for the intended purposes. A 2.5 mm thickness is the preferred embodiment, but a 2 mm or 3 mm, or like, thickness is useful for the intended purposes. The measure mask is sewn together at the seams to join vertical edges 220 to make cover into a cylinder. Cylinder cover fits over most hoppers, particularly those of complimentary cylindrical shape. The cover is intended to employ an open top along top edge 222 (in circle or like shape when applied) to allow the hopper to be reloaded while cover remains situated.

Card slot 205 is provided with top fasteners 204 defining an open top edge therebetween to allow a card to slide in from the top of the slot. Lower fasteners 206 are provided and may be joined with seams or otherwise attached at lines 201, 202 and 203 to fasteners, forming a pocket. Pocket may be made from a plastic sleeve that is intended to be transparent to allow a card placed therein to be visible. The size of card slot 205 is intended to match those sized of the prior art and may be sized of the typical business card or info card as is known the in the art of powder measures. Card can provide information on the type of powder, thrown powder needed per operation, etc.

The morale patch 210 includes corners 211 and sides 212. A morale patch is intended to provide removable ornamentation as is known in the art, typically a 2" by 3" patch size to be fitted with complimentary hook and loop fastening. A viewing window 230 with height 231 may include an aperture in the cover to provide for direct access to the hopper wall. The window may alternatively be filled with a transparent material. The preferred window slit is towards the lower end of the cover to allow indication when supply is running low. Typically, the window aperture will begin no less than ½" from the bottom edge 221 and more preferably at 1" from the bottom edge. The window is preferably at least 1", and possibly 1.5" and any increment up to 2.5" in height. An alternative window 240 with height 241 may be included to provide a more complete report of supply at various fill levels. This longer window may be as much as 90% but preferably no more than 75% of the height of the cover, and preferably at least ½" from either edge, if not 1". It is preferred to use a smaller window as the preferred neoprene cover material will be compromised with such a long slit. Therefore staggered windows, such as 232 and 233, may be included with window 230 to provide from more information as to supply levels at more fill levels.

I claim:

1. A powder measure with adapted cover, said powder measure comprising:

(a) a hopper adapted to hold a quantity of granular propellant in a reservoir, said hopper reservoir comprising a cylindrical tube and a wall circumscribing said cylindrical tube;

(b) a tubular sleeve, said tubular sleeve adapted to mate with said hopper reservoir wall;

(c) said cover further comprising a pouch on an external face;

(d) said pouch comprising an open top end; and (e) a window aperture along said cover adapted to provide viewing access of the hopper when applied.

2. The powder measure with adapted cover as set forth in claim 1 further comprising an ornamental indicia on a face of the cover.

3. The powder measure with adapted cover as set forth in claim 2 wherein said ornamental indicia includes a morale patch with hook and loop fastener.

4. The powder measure with adapted cover as set forth in claim 1 wherein said window aperture includes a transparent material filling therein.

5. The powder measure with adapted cover as set forth in claim 1 further comprising a second window aperture.

6. The powder measure with adapted cover as set forth in claim 5 further comprising a third window aperture.

7. The powder measure with adapted cover as set forth in claim 5 wherein said window aperture and said second window aperture are staggered.

* * * * *